US006032905A

United States Patent [19]

Haynie

[11] Patent Number: 6,032,905

[45] Date of Patent: Mar. 7, 2000

[54] SYSTEM FOR DISTRIBUTED AUTOMATIC TRAIN SUPERVISION AND CONTROL

[75] Inventor: Michael B. Haynie, Butler County, Pa.

[73] Assignee: Union Switch & Signal, Inc., Pittsburgh, Pa.

[21] Appl. No.: 09/134,139

[22] Filed: Aug. 14, 1998

[51] Int. Cl.[7] ..... B61L 27/00

[52] U.S. Cl. ..... 246/3; 246/167 R

[58] Field of Search ..... 246/2 R, 3, 4, 246/62, 167 R, 182 R

[56] References Cited

U.S. PATENT DOCUMENTS

| | | | |
|---|---|---|---|
| 2,567,887 | 9/1951 | McCann | 246/134 |
| 5,332,180 | 7/1994 | Peterson et al. | 246/3 |
| 5,398,894 | 3/1995 | Pascoe | 246/28 R |
| 5,533,695 | 7/1996 | Heggestad et al. | 246/182 R |
| 5,950,966 | 9/1999 | Hungate et al. | 246/182 R |

*Primary Examiner*—Mark T. Le
*Attorney, Agent, or Firm*—David V. Radack; Eckert Seamans Cherin & Mellott, LLC

[57] ABSTRACT

A system for supervising and controlling the movement of a railway vehicle is provided, wherein a plurality of wayside controller units are each distributed to a plurality of wayside controller locations by a multi-access carrier, such as a fiber LAN or IEEE 802.3 Ethernet, for instance, such that supervisory and control operations may be communicated between each of the wayside controller units with a multi-access protocol on the multi-access carrier. The present invention replaces the use of a serial-link protocol for point-to-point communication with a multi-access protocol on a multi-access carrier. In a preferred embodiment, a computer-based control system may be connected through the multi-access carrier, so that communication is achieved solely with multi-access protocols. Related art Centralized traffic control (CTC) functions may be eliminated from a global services (GS) block of the central office (CO) and implemented as Distributed Traffic Control functions that are distributed to the wayside controller units.

10 Claims, 5 Drawing Sheets

SYSTEM FOR DISTRIBUTED AUTOMATIC TRAIN SUPERVISION AND CONTROL

BACKGROUND OF THE INVENTION

1. Field of the Invention

The present invention relates generally to supervision and control of one or more railway vehicles and, more particularly, to distributed automatic train supervision and control of one or more railway vehicles on a network of a plurality of sections of track having corresponding wayside controller equipment and carborne train operation equipment.

2. Description of the Related Art

In the related art, the movement of railway vehicles within a railway system has been conventionally controlled from a central office with point-to-point serial communication links to each of a plurality of wayside units within the railway system. FIG. 1 shows a block diagram of a conventional control system 100, wherein a redundant configuration comprising a primary master server (PMS) 110 and a secondary master server (SMS) 112 is linked with one or more operator consoles (OC) 114, 116 through a Local Area Network (LAN) 118, possibly an Ethernet or similar network, to a communications server (CS) 120. A wayside controller unit $WCU_{1A}$, $WCU_{2A}$, . . . $WCU_{nA}$ is located at each wayside controller location $WCL_{1A}$, $WCL_{2A}$, . . . $WCL_{nA}$, respectively. Each $WCU_{1A}$, $WCU_{2A}$, . . . $WCU_{nA}$ is serial linked through dedicated serial links $\mathbf{119}_1$, $\mathbf{119}_2$, . . . $\mathbf{119}_n$, such as a copper cable having an RS-232 connection over two twisted pair or similar, for instance, to the communication server 120. Each $WCU_{1A}$, $WCU_{2A}$ . . . $WCU_{nA}$ comprises one or more microprocessor-based control units (CU) $\mathbf{122}_1$, $\mathbf{122}_2$ . . . $\mathbf{122}_n$ for non-vital operation logic and Input/Output (I/O), such as a GENISYS® system, and microprocessor-based control units (CU) $\mathbf{124}_1$, $\mathbf{124}_2$ . . . $\mathbf{124}_n$ for vital operation logic and I/O, such as a MICROLOK® system. The GENISYS® system and MICROLOK® system is commonly known to be manufactured by Union Switch & Signal Inc. (US&S®) of Pittsburgh, Pa., U.S.A.

FIG. 2 shows a typical implementation of the control system 100 of FIG. 1. A central office (CO) location 200 typically has a global services (GS) block 210 and an operator console (OC) block 212. The GS block 210 maintains various commonly known railroad operation functions, including a vehicle regulation (VR) block 214, a centralized traffic control (CTC) block 216, and a train tracking (TTT) block 218. The OC 212 maintains various commonly known interfaces, including a man-machine interface (MMI) 220 and a code system interface (CSI) 222. The GS block 210 and the OC block 212 are linked to communicate with each other through a message switching service (MSS) 224. The CSI 222 is linked with a serial link 228 over a multi-access carrier, such as a LAN (not shown), to a communication server (CS) 230, such as a commonly known terminal server. Typically, the CS 230 is linked to a plurality of wayside controller units $WCU_{1B}$, $WCU_{2B}$, . . . $WCU_{nB}$, which are located at each wayside location $WCL_{1B}$, $WCL_{2B}$, . . . $WCL_{nB}$, respectively, through dedicated serial links $\mathbf{232}_1$, $\mathbf{232}_2$, . . . $\mathbf{232}_n$, such as a copper cable for instance. Typically each $WCU_{1B}$, $WCU_{2B}$, . . . $WCU_{nB}$ includes, respectively, a non-vital logic (NVL) unit $\mathbf{234}_1$, $\mathbf{234}_2$, . . . $\mathbf{234}_n$, such as a GENISYS® 2000 unit manufactured by US&S, and a vital logic (VL) unit $\mathbf{236}_1$, $\mathbf{236}_2$, . . . $\mathbf{236}_n$, such as a MICROLOK® unit manufactured by US&S. Redundancy is commonly provided by linking a second NVL unit $\mathbf{238}_1$, $\mathbf{238}_2$, . . . $\mathbf{238}_n$ and a second VL unit $\mathbf{240}_1$, $\mathbf{240}_2$, . . . $\mathbf{240}_n$ to the serial link $\mathbf{232}_1$, $\mathbf{232}_2$, . . . $\mathbf{232}_n$ that connects each $WCU_{1B}$, $WCU_{2B}$, . . . $WCU_{nB}$, respectively, to the CS 230. Each of the second NVL units $\mathbf{238}_1$, $\mathbf{238}_2$, . . . $\mathbf{238}_n$ may be a GENISYS® 2000 unit and each of the second VL units $\mathbf{240}_1$, $\mathbf{240}_2$, . . . $\mathbf{240}_n$ may be a MICROLOK® unit.

In FIG. 2, as is known in the art, each redundant NVL unit $\mathbf{234}_1$, $\mathbf{234}_2$, . . . $\mathbf{234}_n$, and $\mathbf{238}_1$, $\mathbf{238}_2$, . . . $\mathbf{238}_n$ has non-vital operation logic that controls such commonly known functions as signal clear-ahead, entrance-exit routing, and local control panel logic. Likewise, each redundant VL unit $\mathbf{236}_1$, $\mathbf{236}_2$, . . . $\mathbf{236}_n$ and $\mathbf{240}_1$, $\mathbf{240}_2$, . . . $\mathbf{240}_n$ has vital operation logic that relates to commonly known train protection and safety systems such as switch indication and control functions. These railroad operations and control functions are typically implemented with commonly known physical relays and/or relay logic emulation on a microprocessor. In the related art, the relay logic must be constructed uniquely for each $WCL_{1B}$, $WCL_{2B}$, . . . $WCL_{nB}$ because portions of the relay logic are sensitive to the layout and connectivity of particular track sections that are being controlled by each particular NVL and VL unit at each particular $WCL_{1B}$, $WCL_{2B}$, . . . $WCL_{nB}$. The design and implementation work for each WCL may be somewhat mitigated by using semi-standard logic templates, but these templates cannot represent functions that depend on the local structure of the railroad, such as a commonly known route locking function, for instance.

The communication from the CO 200 to each $WCL_{1B}$, $WCL_{2B}$, . . . $WCL_{nB}$ was typically achieved through a serial link protocol for point-to-point communication on a point-to-point carrier, such as an RS-232 connection over two twisted pair or similar, as shown in FIG. 1. Newer installations replace the dedicated serial links $\mathbf{232}_1$, $\mathbf{232}_2$, . . . $\mathbf{232}_n$, known as a point-to-point copper cable bundle, with a router 310 and a multi-access carrier 320, such as a fiber-optic ring for instance, while still maintaining a point-to-point communications protocol over serial links $\mathbf{321}_1$, $\mathbf{321}_2$, . . . $\mathbf{321}_n$, that respectively connect to a $WCU_{1C}$, $WCU_{2C}$, . . . $WCU_{nC}$ at a $WCL_{1C}$, $WCL_{2C}$, . . . $WCL_{nC}$, as shown in FIG. 3. Similarly to FIG. 1, each $WCU_{1C}$, $WCU_{2C}$, . . . $WCU_{nC}$ comprises one or more microprocessor-based control units (CU) $\mathbf{322}_1$, $\mathbf{322}_2$ . . . $\mathbf{322}_n$ for non-vital operation logic and Input/Output (I/O), such as a GENISYS® system, and microprocessor-based control units (CU) $\mathbf{324}_1$, $\mathbf{324}_2$ . . . $\mathbf{324}_n$ for vital operation logic and I/O, such as a MICROLOK® system.

In FIG. 3 the servers 110, 112 carry out commonly known non-vital operation logic for functions such as signal clear-ahead and entrance-exit routing (thereby duplicating these non-vital functions that are also implemented on non-vital wayside controller units $WCU_{1C}$, $WCU_{2C}$, . . . $WCU_{nC}$ located at wayside controller locations $WCL_{1C}$, $WCL_{2C}$, . . . $WCL_{nC}$), along with other functions that are not performed at the $WCU_{1C}$, $WCU_{2C}$, . . . $WCU_{nC}$, such as train tracking and vehicle regulation. Note that duplicated conventional functions, such as signal clear-ahead and entrance-exit routing (not shown), are not implemented using relay logic emulation, but are implemented using generalized software-based functions. Thus, conventional functions such as signal clear-ahead and entrance-exit routing are implemented only once and are applied to a number of locations where the functions are required. Configuration information of the particular WCL from a conventional database (not shown), which information includes how the particular WCL is organized, provides the required information about the location to drive variations in the behavior of the function, such as the switch and signal states needed for an entrance-exit routing, for instance.

A problem with the configurations of FIGS. 1, 2 and 3 is the excessive costs arising from the large amount of logic duplicated on the wayside controller units (WCU) and the CO 200 (especially non-vital operation logic such as train routing), particularly in terms of additional hardware, software and engineering. There are also significant limitations as to the types of operation logic that can be reasonably carried out by the non-vital WCL units, given the amount and type of information that is available to them, and the relay-logic representation that is used to program them. For instance, implementation of train tracking in relay logic is impractical. Additionally, with regard to duplication, the location of the CTC 216 at the GS 210 requires duplication of functionality logic at both the GS 210 and the $WCL_{1B}$, $WCL_{2B}$, . . . $WCL_{nB}$.

In addition, conventional Automatic Train Protection (ATP) systems were implemented with a combination of vital wayside interlocking equipment and vital car-borne equipment. Such equipment communicates to an Automatic Train Operation (ATO) system (not shown) located on the vehicle (not shown) and on the wayside (not shown) through serial links or code lines. Logic for railroad operations and control functions is implemented using physical relays or some microprocessor-based system that simulates relay logic. Examples of such equipment would be a MICROLOK® system and a MICROTRAX® system on the wayside and a MICROCAB® system on the vehicle. Each of these systems are commonly known to be manufactured by Union Switch & Signal Inc. of Pittsburgh, Pa., U.S.A. The ATO system on the wayside is implemented using non-vital wayside equipment. Each wayside ATO system comprised simple non-vital road operation logic, such as typical functions implemented in a US&S® product named Union Route, for instance, and local control panel interface logic. The US&S® product named Union Route is described in detail in U.S. Pat. No. 2,567,887, which issued Sep. 11, 1951 in the name of McCann, and which is incorporated herein by reference. Such logic is also implemented using physical relays or some microprocessor-based relay simulation systems such as GENISYS®, but without the vitality requirement. The logic is designed to operate correctly with or without proper communication to the CO 200. Communication to the CO 200 was usually carried out with the serial link 228 or similar code line, as shown in FIG. 2. Automatic Train Operation in the CO 200 comprises computer programs that largely duplicate the functionality of each wayside ATO system, but use procedural computer programs rather than relay logic simulation. In some cases, even the control panel logic is duplicated to drive control panels or model boards. Automatic Train Supervision (ATS) is implemented in the CO 200 using the same or similar computers as ATO. These ATO/ATS/ATP systems are typically fully redundant to ensure graceful and minimal reduction of system performance should portions of the system fail. However, loss of communications with the CO 200 would result in the loss of high-level supervisory functions from ATS, such as automatic routing of trains according to a schedule, known as vehicle regulation. Manual supervisory control from the CO 200 would also be lost in this event.

Consequently, a need exists for distributing to the wayside controller locations those non-global automatic train supervision and control functions that have been previously centralized at the central office CO 200.

SUMMARY OF THE INVENTION

It is therefore an object of the present invention to provide an improved system for distributed automatic train supervision and control.

It is another object of the present invention to provide an improved system for distributed automatic train supervision and control by replacing the use of a serial-link protocol for point-to-point communication with a multi-access protocol on a multi-access carrier.

It is another object of the present invention to implement a multi-access protocol on a multi-access carrier in a network-based local area network (LAN) configuration, for use by a distributed automatic train supervision and control system.

It is a feature of the present invention to distribute to the wayside locations certain non-global automatic train supervision and control functions that have been previously centralized at the central office CO 200.

It is another feature of the present invention to provide improved robostness of functionality existing between interrelated elements of the present invention.

In accordance with a preferred embodiment of the present invention, a system for supervising and controlling the movement of a railway vehicle is provided, wherein a plurality of wayside controller units are each distributed to a plurality of wayside controller locations by a multi-access carrier, such as a fiber LAN or IEEE 802.3 Ethernet, for instance, such that supervisory and control operations may be communicated between each of the wayside controller units with a multi-access protocol on the multi-access carrier. In a preferred embodiment, a computer-based control system may be connected through the multi-access carrier, so that communication is achieved solely with multi-access protocols. Related art Centralized traffic control (CTC) functions may be eliminated from a global services (GS) block of a central office (CO) and implemented as Distributed Traffic Control functions that are distributed to the wayside controller units.

Briefly described according to a preferred embodiment of the present invention, a system is provided for distributed automatic supervision and control of a railway vehicle among a plurality of wayside locations, wherein the system comprises: a plurality of wayside controller units, each located at one of a plurality of wayside locations, respectively, thereby to transmit a first generated signal and to receive a plurality of subsequent signals related to supervision and control of each one of the plurality of wayside controller units; multi-access transport means for communicating between each one of the plurality of the wayside controller units, through substantially simultaneous transmission of the first generated signal and the plurality of subsequent signals,wherein each of the plurality of the wayside controller units is electrically coupled to the multi-access transport means; and operator interface means units electrically coupled to the multi-access transport means, for interacting by an operator with the plurality of wayside controller units.

An advantage of the present invention is that one wayside controller unit at a first location may control another wayside controller unit at a second location in the event of lost communication with the central office.

Another advantage of the present invention is that the relocation of software components to the wayside controller units eliminates the existing non-vital controller (which is relay-logic emulation based) along with the attendant duplication of logic.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

1. Detailed Description of the Figures

Figure 4:
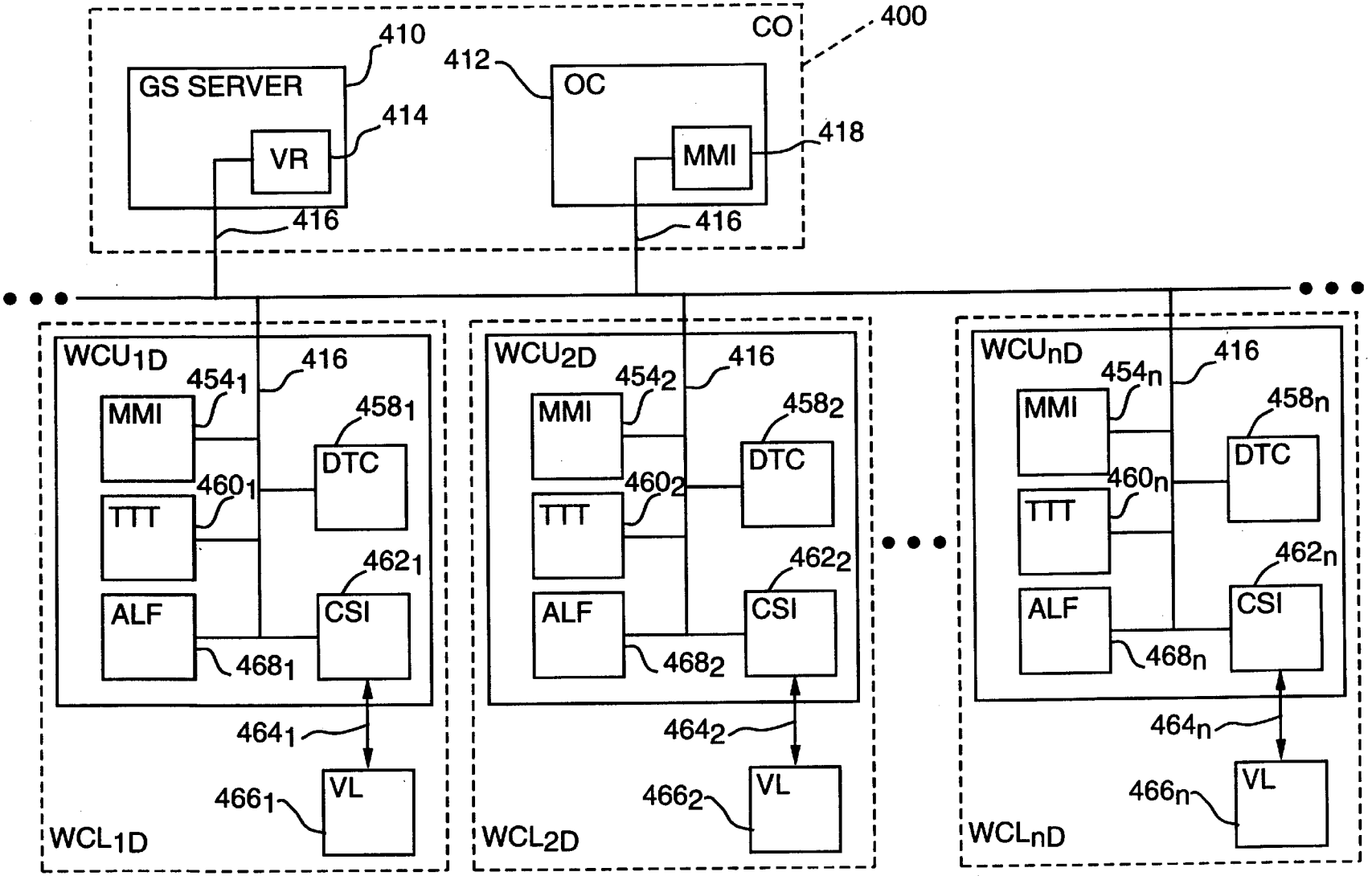
FIG. 4 is a block diagram of a preferred embodiment of the present invention.
Figure 5:
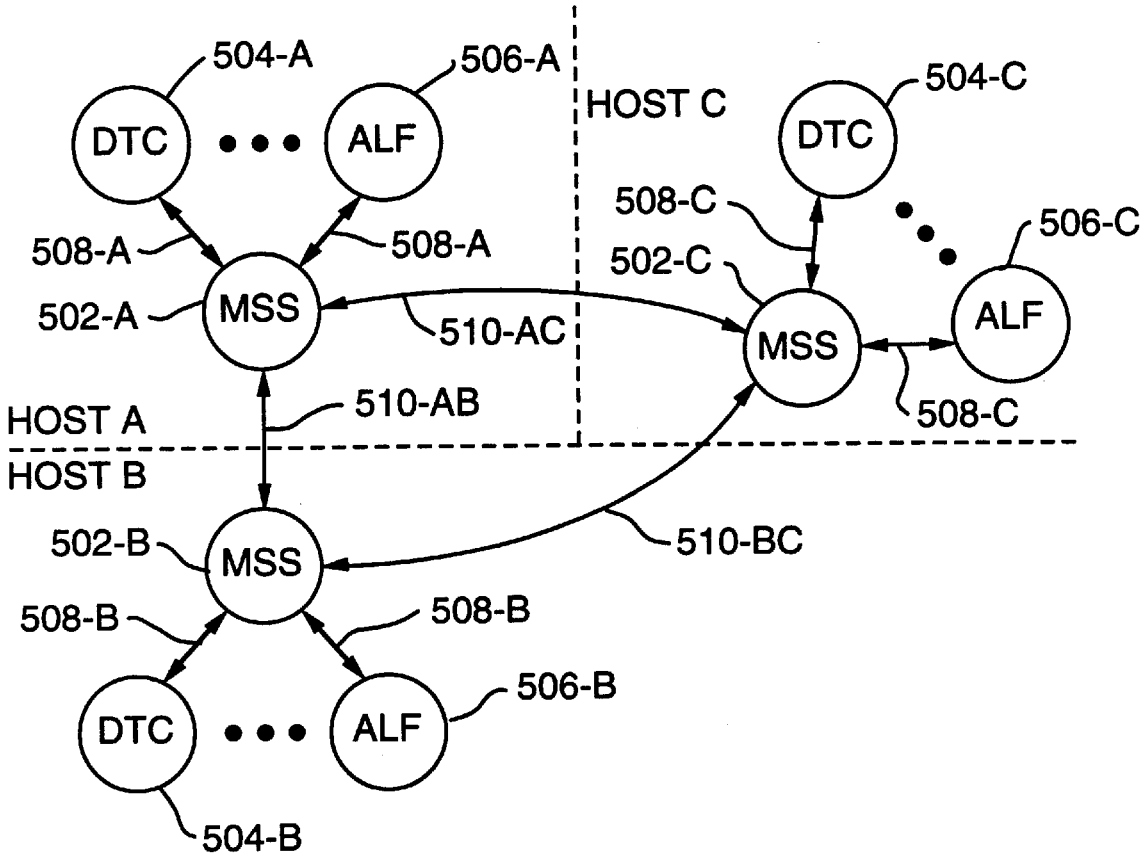
FIG. 5 is a block diagram of a fully connected ring of a message switching service utilized in the present invention.

Referring now to FIG. 4, a block diagram of a preferred embodiment of the present invention shows a central office (CO) 400 having a global services (GS) server block 410 and an operator console (OC) block 412. The GS server block 410 has a vehicle regulation (VR) block 414 that is interconnected to a multi-access transport means, identified as a message switching service (MSS) 416, for communicating between multiple locations. Although the MSS 416 is shown as a logical bus in FIG. 4, the MSS 416 may be implemented as a plurality of separate tasks, as shown in FIG. 5. The OC block 412 has a man-machine interface (MMI) 418 that is interconnected to the MSS 416. Interconnections to the MSS 416 are accomplished via a commonly known Transmission Control Protocol/Internel Protocol (TCP) socket connection or session link (not shown), thereby to form a session layer transport in the commonly known seven layer stack of an International Standard Organization/Open Systems Interconnect ISO/OSI model.

Figure 1:
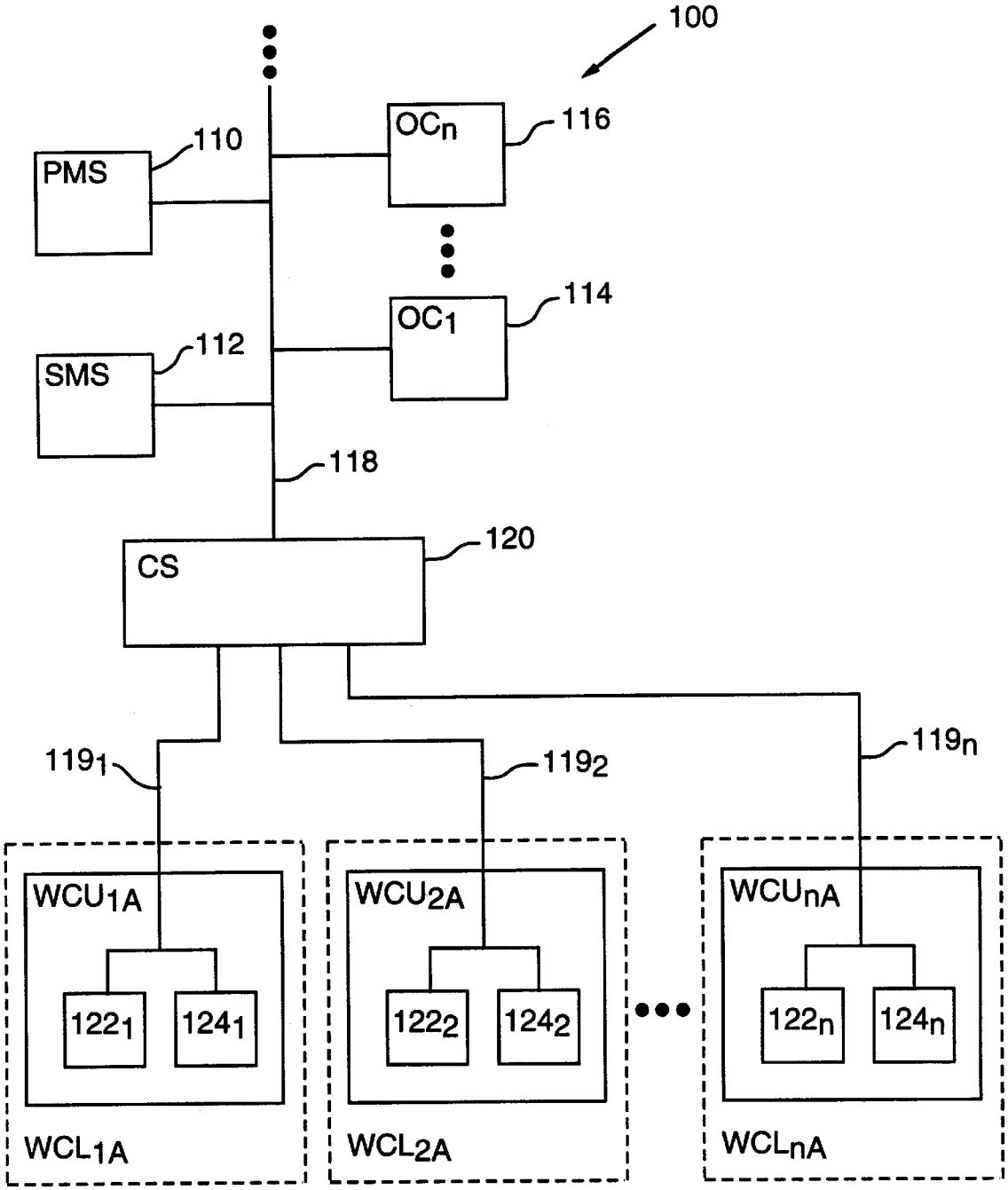
FIG. 1 Prior Art
FIG. 1 is a block diagram of and automatic train supervision and control system of the prior art.
Figure 2:
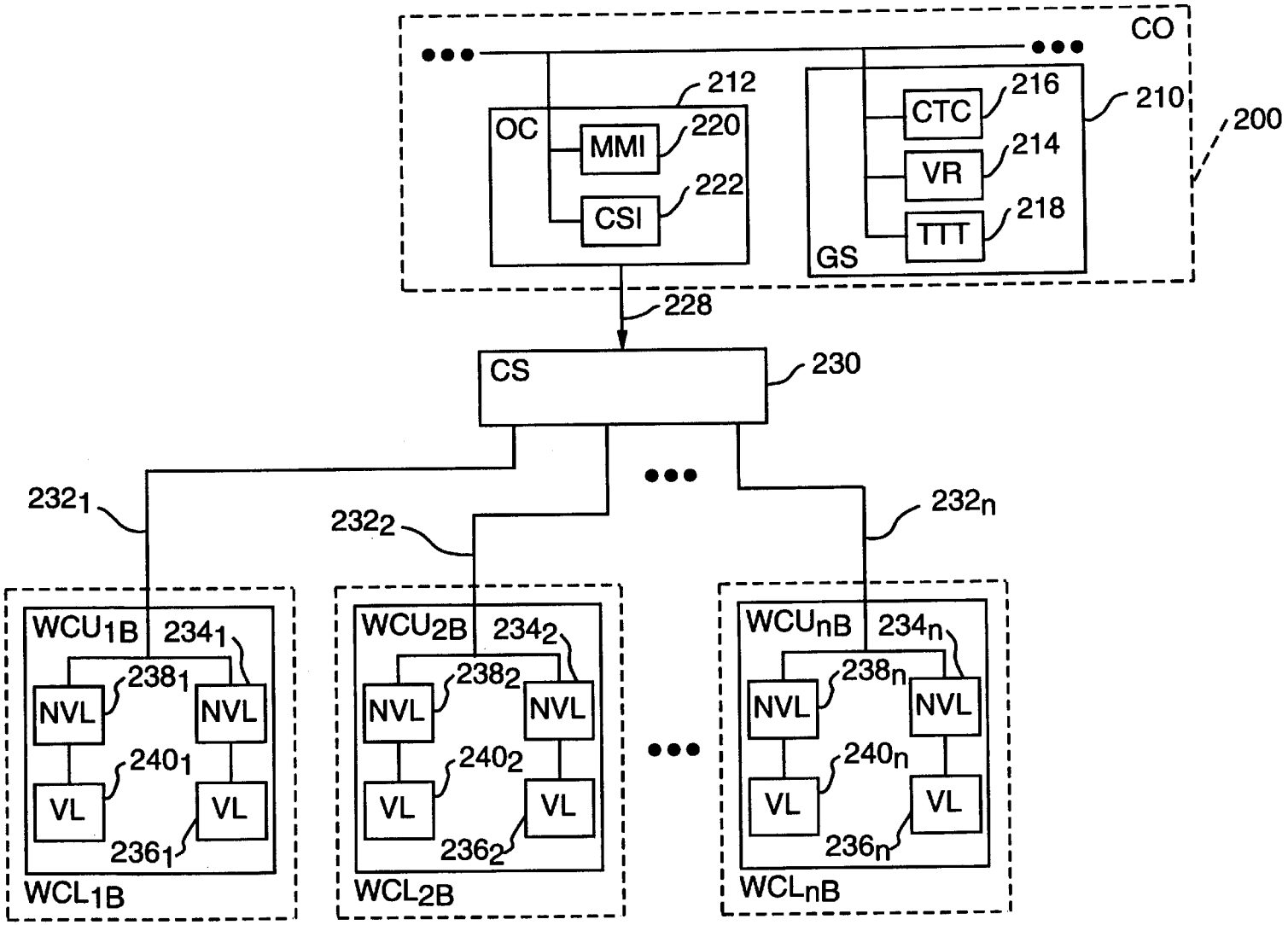
FIG. 2 Prior Art
FIG. 2 is a block diagram of a more detailed implementation the automatic train supervision and control system of FIG. 1.
Figure 3:
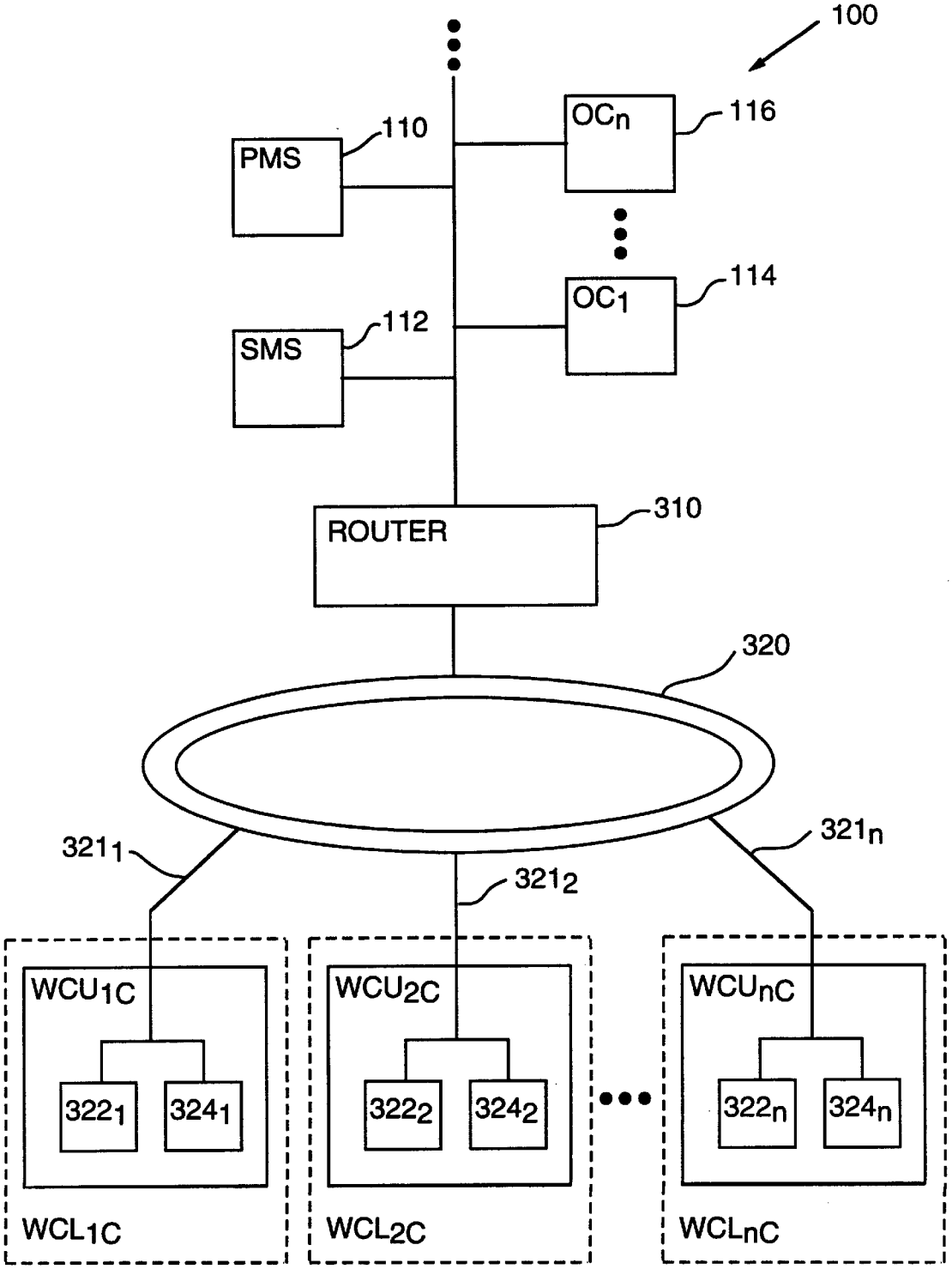
FIG. 3 Prior Art
FIG. 3 is a block diagram implementation of the automatic train supervision and control system of FIG. 1 implemented with a router and a fiber-optic ring.

A wayside controller unit $WCU_{1D}$, $WCU_{2D}$, . . . $WCU_{nD}$ is located at each wayside location $WCL_{1D}$, $WCL_{2D}$, . . . $WCL_{nD}$, respectively. Each $WCU_{1D}$, $WCU_{2D}$, . . . $WCU_{nD}$ comprises respective Man-Machine Interface (MMI) blocks $\mathbf{454}_1$, $\mathbf{454}_2$, . . . $\mathbf{454}_n$, respective Distributed Traffic Control (DTC) blocks $\mathbf{458}_1$, $\mathbf{458}_2$, . . . $\mathbf{458}_n$, respective Train Tracking Task (TTT) blocks $\mathbf{460}_1$, $\mathbf{460}_2$, . . . $\mathbf{460}_n$, and respective Code System Interface (CSI) blocks $\mathbf{462}_1$, $\mathbf{462}_2$, . . . $\mathbf{462}_n$. In a preferred embodiment of the present invention, the functionality of the CTC block 216 at the GS server block 210 shown in FIG. 2 (prior art) has been transferred to each wayside location $WCL_{1D}$, $WCL_{2D}$, . . . $WCL_{nD}$ with each respective DTC block $\mathbf{458}_1$, $\mathbf{458}_2$, . . . $\mathbf{458}_n$. The distributed traffic control functionality of each respective DTC block $\mathbf{458}_1$, $\mathbf{458}_2$, . . . $\mathbf{458}_n$ may be implemented with software that is substantially similar to the software with which the centralized traffic control functionality of the CTC block 216 is implemented.

Each respective CSI block $\mathbf{462}_1$, $\mathbf{462}_2$, . . . $\mathbf{462}_n$ is a specific interface that permits communication via a respective local serial link $\mathbf{464}_1$, $\mathbf{464}_2$, . . . $\mathbf{464}_n$ between each respective $WCU_{1D}$, $WCU_{2D}$, . . . $WCU_{nD}$ and a repective vital logic (VL) block $\mathbf{466}_1$, $\mathbf{466}_2$, . . . $\mathbf{466}_n$. Each TTT block $\mathbf{460}_1$, $\mathbf{460}_2$, . . . $\mathbf{460}_n$ keeps track of where each train (not shown) is, and an "Autorouting Logic for Fallback" (ALF) block $\mathbf{468}_1$, $\mathbf{468}_2$, . . . $\mathbf{468}_n$ determines where each train should go. The MSS 416 permits each DTC block $\mathbf{458}_1$, $\mathbf{458}_2$, . . . $\mathbf{458}_n$ to communicate using a session layer protocol corresponding to the session link for interconnections to MSS 416. A broadcast over the MSS 416 from any of the DTC blocks $\mathbf{458}_1$, $\mathbf{458}_2$, . . . $\mathbf{458}_n$ establishes connectivity, and then logical pair-wise connections are established, resulting in the fully connected ring 500 shown in FIG. 5.

FIG. 5 is a detailed block diagram of a preferred embodiment of the implementation of the message switching service MSS 416, which may be implemented with software code as a plurality of tasks to be executed by a general purpose computer. In a preferred embodiment, a set of software tasks may need to be executed on a plurality of computer hosts. For simplicity, three hosts are shown in FIG. 5—a Host A, Host B, and a Host C, although any number of hosts could be included in this implementation. The set of software tasks may be classified into two different classes: MSS servers; and MSS clients.

The MSS servers comprise those separate tasks which provide service to MSS clients, such as, for instance, an MSS server 502-A on Host A, an MSS server 502-B on Host-B, and an MSS server 502-C on Host C. Upon initialization of each of the MSS server, each MSS server broadcasts a request for other MSS servers to identify themselves. A connection subsequently is established between each starting MSS server and each responding MSS server, thereby resulting in a fully connected ring of MSS servers of N nodes and $$\frac{N(N-1)}{2}$$

pairwise connections, where N is the number of MSS servers being initiatialized. FIG. 5 shows: a TCP socket interconnection 510-AB between the MSS 502-A and the MSS 502-B; a TCP socket interconnection 510-BC between the MSS 502-B and the MSS 502-C; and a TCP socket interconnection 510-AC between the MSS 502-A and the MSS 502-C.

The MSS clients comprise those tasks that may request service from a local MSS server, such as, for instance: a DTC block 504-A and an ALF Block 506-A, wherein each is interconnected via a local socket 508-A to the MSS 502-A; a DTC block 504-B and an ALF Block 506-C, wherein each is interconnected via a local socket 508-B to the MSS 502-B; and a DTC block 504-C and an ALF Block 506-C, wherein each is interconnected via a local socket 508-C to the MSS 502-C.

2. Operation of the Preferred Embodiment

In operation, each VL block $\mathbf{466}_1$, $\mathbf{466}_2$, . . . $\mathbf{466}_n$ of FIG. 4 may report train location and movement information in the form of track occupancy data. Each CSI block $\mathbf{462}_1$, $\mathbf{462}_2$, . . . $\mathbf{462}_n$ may receive such train location and movement information from hardware of the VL blocks $\mathbf{466}_1$, $\mathbf{466}_2$, . . . $\mathbf{466}_n$ and transmit such information via MSS 416 for access by any other functional block at the CO 400 or the $WCL_1$, $WCL_2$, . . . $WCL_n$. Each TTT block $\mathbf{460}_1$, $\mathbf{460}_2$, . . . $\mathbf{460}_n$ may receive and utilize such track occupancy data to transmit continually each train position. The VR block 414 may receive a "train movement message" comprising, for instance, train identification, location, direction, and other related information. The VR block 414 may utilize the train movement message along with other information known about the track layout to determine switch positioning and which signals to request clear, thereby to permit the train to proceed on route to its destination. The VR block 414 may request the respective DTC blocks 458$_1$, 458$_2$, . . . 458$_n$ to clear certain predetermined signals and to set certain predetermined switches, thereby to permit the train to proceed on route to its destination. The DTC blocks 458$_1$, 458$_2$, . . . 458$_n$ determine whether a request is permitted by applying known generic functions, such as routlocking, for instance, to configuration information retrieved from a conventional database (not shown) that is related to such request, and to field status information from the VL blocks 458$_1$, 458$_2$, . . . 458$_n$, respectively. If permitted, the respective DTC blocks 458$_1$, 458$_2$, . . . 458$_n$ may transmit a message request to respective CSI blocks 462$_1$, 462$_2$, . . . 462$_n$, which may relay the message request to respective VL blocks 466$_1$, 466$_2$, . . . 466$_n$. The respective VL block 466$_1$, 466$_2$, . . . 466$_n$ verifies that the message request is safe to perform according to commonly known vitality requirements. If the message request is verified to be vitally safe to perform, then the respective VL block 466$_1$, 466$_2$, . . . 466$_n$ performs the message request, which may permit the train to proceed on route to its destination. Each respective DTC block 458$_1$, 458$_2$, . . . 458$_n$ may be enabled to cooperate among themselves in carrying out the verification and implementation of the message request from the VR block 414. In this manner, the CTC block 216 in the GS block 210 of the related art has been eliminated in the GS server block 410 of the present invention, and the DTC blocks 458$_1$, 458$_2$, . . . 458$_n$ at each WCL$_1$, WCL$_2$, . . . WCL$_n$ of the present invention supervise and control operations that were previously duplicated in the related art NVL blocks 234 and 238 of FIG. 2.

In the event of lost communication with CO 400, and subsequent loss of communication with the VR block 414 at the GS server block 410, each respective ALF block 468$_1$, 468$_2$, . . . 468$_n$ takes control of the lost functionality of the VR block 414 for each local WCL$_1$, WCL$_2$, . . . WCL$_n$, respectively. Further, the MMI block 418 may establish a session link on the MSS 416 with each local WCL$_1$, WCL$_2$, . . . WCL$_n$ for control purposes. Therefore, in the event of lost communication with CO 400, and subsequent loss of communication with the VR block 414 at the GS server block 410, each respective WCU$_1$, WCU$_2$, . . . WCU$_n$ at each local WCL$_1$, WCL$_2$, . . . WCL$_n$ may control any other WCU at its local WCL with minimal access points to the MSS 416 This feature of the present invention was not possible in the related art without $$\frac{N(N-1)}{2}$$

physical interconnections between all to the wayside controller locations of interest For instance, in the related art, for N wayside controller locations where N=30, $$\frac{30(30-1)}{2} = 435$$

physical interconnections between the wayside controller locations are required to enable each WCU at each local WCL to control any other WCU at its local WCL. By contrast, the present invention requires only N=30 access points to the multi-access transport carrier of MSS 416.

The foregoing description of the preferred embodiment of the present invention has been presented for purposes of illustration and description. It is not intended to be exhaustive or to limit the present invention to the precise form disclosed, and obviously many modifications and variations are possible in light of the above teachings.

The preferred embodiment was chosen and described in order to best explain the principles of the present invention and its practical application to those persons skilled in the art, and thereby to enable those persons skilled in the art to best utilize the present invention in various embodiments and with various modifications as are suited to the particular use contemplated. It is intended that the scope of the present invention be broadly defined by the claims which follow.

What is claimed is:

1. A system for supervision and control of a rail vehicle on a network of a plurality of sections of track having corresponding wayside locations, the system comprising:

multi-access transport means for communicating between a first location and a plurality of subsequent locations, through substantially simultaneous transmission of a first signal from a said first location to said plurality of subsequent locations, and substantially simultaneous receipt at said first location of a plurality of subsequent signals from said plurality of subsequent locations, respectively;

a plurality of wayside controller units, one each respectively located at the corresponding wayside locations, and each electrically coupled to said multi-access transport means, thereby to transmit said first signal and to receive said plurality of subsequent signals between each of said plurality of wayside controller units, for local configuration and reporting and control of said plurality of wayside controller units; and operator interface means electrically coupled to said multi-access transport means, for interacting by an operator with said plurality of wayside controller units.

2. The system according to claim 1, further comprising:

distributed traffic control means, located at each of said plurality of wayside controller units, for maintaining safe and efficient operation of the rail vehicle on the network of the plurality of sections of track, in accordance with said first signal and said plurality of subsequent signals received by each of said plurality of wayside controller units, respectively.

3. The system according to claim 2, further comprising:

automatic supervisory control means electrically coupled to said multi-access transport means, thereby to transmit said first signal and to receive said plurality of subsequent signals between said wayside controller units and said automatic supervisory control means, for system-wide configuration and reporting and control of the rail vehicle on the network of the plurality of sections of track; and wherein said operator interface means provides interacting by said operator with said automatic supervisory control means via said multi-access transport means.

4. The system according to claim 2, further comprising:

autorouting logic means, located at each of said plurality of wayside controller units, for maintaining a desired route of travel of the rail vehicle in accordance with predetermined operational goals.

5. The system according to claim 2, further comprising:

train tracking means, located at each of said plurality of wayside controller units, for tracking the railway along the network of the plurality of sections of track, in accordance with said first signal and said plurality of subsequent signals received by each of said plurality of wayside controller units, respectively.

6. A system for distributed automatic supervision and control of a railway vehicle among a plurality of wayside locations, wherein the system comprises:

a plurality of wayside controller units, each located at one of a plurality of wayside locations, respectively, thereby to transmit a first generated signal and to receive a plurality of subsequent signals related to supervision and control of each one of said plurality of wayside controller units;

multi-access transport means for communicating between each one of said plurality of said wayside controller units, through substantially simultaneous transmission of said first generated signal and said plurality of subsequent signals,wherein each of said plurality of said wayside controller units is electrically coupled to said multi-access transport means; and operator interface means electrically coupled to said multi-access transport means, for interacting by an operator with said plurality of wayside controller units.

7. The system according to claim 6, further comprising:

distributed traffic control means, located at each of said plurality of wayside controller units, for maintaining safe and efficient operation of the railway vehicle among the plurality of wayside locations, in accordance with said first generated signal and said plurality of subsequent signals received by each of said plurality of wayside controller units, respectively.

8. The system according to claim 7, further comprising:

automatic supervisory control means electrically coupled to said multi-access transport means, thereby to transmit said generated first signal and to receive said plurality of subsequent signals between said wayside controller units and said automatic supervisory control means, for system-wide configuration and reporting and control of the railway vehicle among the plurality of wayside locations; and wherein said operator interface means provides interacting by said operator with said automatic supervisory control means via said multi-access transport means.

9. The system according to claim 7, further comprising:

autorouting logic means, located at each of said plurality of wayside controller units, for maintaining a desired route of travel of the railway vehicle in accordance with predetermined operational goals.

10. The system according to claim 7, fuirther comprising:

train tracking means, located at each of said plurality of wayside controller units, for tracking the railway vehicle among the plurality of wayside locations, in accordance with said first generated signal and said plurality of subsequent signals received by each of said plurality of wayside controller units, respectively.

* * * * *